US007694349B2

(12) United States Patent
Skottheim

(10) Patent No.: US 7,694,349 B2
(45) Date of Patent: Apr. 13, 2010

(54) CORE PROTECTOR WITH ADJUSTABLE THIGH PROTECTORS

(75) Inventor: Leif Skottheim, Malung (SE)

(73) Assignee: Sport Maska Inc., Montreatl, Quebec (CA)

( * ) Notice: Subject to any disclaimer, the term of this patent is extended or adjusted under 35 U.S.C. 154(b) by 0 days.

(21) Appl. No.: 11/580,190

(22) Filed: Oct. 13, 2006

(65) Prior Publication Data

US 2007/0101475 A1 May 10, 2007

Related U.S. Application Data

(60) Provisional application No. 60/726,190, filed on Oct. 14, 2005.

(51) Int. Cl.
*A41D 13/00* (2006.01)

(52) U.S. Cl. ..... 2/69; 2/212; 2/213; 2/227; 2/80; 2/22; 2/23

(58) Field of Classification Search ..... 2/69, 2/212, 213, 269, 227, 80, 84, 228, 70, 83, 2/247, 2.15, 24, 22, 23, 303, 306, 300, 302
See application file for complete search history.

(56) References Cited

U.S. PATENT DOCUMENTS

| | | | | | |
|---|---|---|---|---|---|
| 1,669,085 | A | * | 5/1928 | Guyon | 2/23 |
| 3,266,057 | A | * | 8/1966 | Phelps | 2/227 |
| 3,594,817 | A | | 7/1971 | Kelly | |
| 4,215,435 | A | * | 8/1980 | Miele | 2/227 |
| 4,325,148 | A | | 4/1982 | Livernois | |
| 4,766,613 | A | * | 8/1988 | Wells | 2/227 |
| 4,811,427 | A | | 3/1989 | Regan | |
| 5,182,812 | A | * | 2/1993 | Goldsby | 2/79 |
| 5,539,927 | A | | 7/1996 | Holubec | |
| 5,581,817 | A | * | 12/1996 | Hicks | 2/239 |
| 5,608,915 | A | | 3/1997 | Libit | |
| 5,717,996 | A | * | 2/1998 | Feldmann | 2/22 |
| D394,543 | S | * | 5/1998 | Lindaman | D2/936 |
| D395,158 | S | * | 6/1998 | Lindaman | D2/986 |
| 5,774,892 | A | * | 7/1998 | Tisdale et al. | 2/69 |
| 5,864,888 | A | * | 2/1999 | Archer | 2/227 |
| 5,926,856 | A | | 7/1999 | Duval | |
| 6,023,789 | A | | 2/2000 | Wilson et al. | |
| 6,701,533 | B2 | | 3/2004 | Webb | |
| 6,782,559 | B2 | | 8/2004 | Regan | |
| 6,804,832 | B2 | | 10/2004 | Beland | |
| 6,978,484 | B2 | * | 12/2005 | Donlan et al. | 2/227 |

(Continued)

FOREIGN PATENT DOCUMENTS

| | | |
|---|---|---|
| CA | 2076131 A1 | 2/1994 |

(Continued)

*Primary Examiner*—Gary L Welch
*Assistant Examiner*—Alissa J Tompkins
(74) *Attorney, Agent, or Firm*—Birch, Stewart, Kolasch & Birch, LLP

(57) ABSTRACT

A core protector including a pant having a torso portion and two tubular leg portions extending therefrom in communication therewith, each leg portion defining an opening for receiving a leg of a wearer therein, and a thigh protector adjacent each leg opening, each thigh protector being detachably connected to the pant to provide protection to a thigh of the wearer.

27 Claims, 6 Drawing Sheets

U.S. PATENT DOCUMENTS

| | | | | |
|---|---|---|---|---|
| 7,237,270 | B2 | 7/2007 | Crye et al. | |
| 2002/0178483 | A1 | 12/2002 | Beland | |
| 2003/0056275 | A1 | 3/2003 | Regan | |
| 2003/0093852 | A1 | 5/2003 | Webb | |
| 2005/0076421 | A1* | 4/2005 | Littzi | 2/239 |
| 2006/0282938 | A1 | 12/2006 | Jewell et al. | |
| 2007/0101474 | A1 | 5/2007 | Skottheim et al. | |
| 2007/0234467 | A1 | 10/2007 | Leach et al. | |

FOREIGN PATENT DOCUMENTS

| | | | |
|---|---|---|---|
| CA | 2130644 | A1 | 7/1996 |

* cited by examiner

CORE PROTECTOR WITH ADJUSTABLE THIGH PROTECTORS

CROSS-REFERENCE TO RELATED APPLICATIONS

The present application claims priority on provisional U.S. patent application Ser. No. 60/726,190 filed Oct. 14, 2005, which is incorporated by reference herein in its entirety.

FIELD OF THE INVENTION

The present invention relates to protective equipment to be used in the game of hockey, for example, ice hockey, street hockey, in-line skate hockey and so on.

BACKGROUND ART

Hockey is a contact sport, and as such, players must be protected against impact, either from other players, from the boards, or from falls on the ice, pavement, etc. In order to protect the mid-portion of a player's body, the region which roughly comprises the area from above the knees to the mid-back portion, and which covers front, back and lateral sides, players have traditionally worn what is known as hockey pants. Hockey pants have traditionally been slipped on over other equipment, such as, for example, his athletic protector, shin guards, socks and even sometimes skates.

Traditional hockey pants are generally made of strong nylon or a similar material and completely cover the mid portion of the wearer. Such pants are usually in the general form of an oversized pair of shorts. Traditional hockey pants may comprise a single layer or alternatively, a number of layers, for example, an inner layer of material in contact with the skin of the wearer and an opposed outer layer. Further, traditional hockey pants usually include a variety of protective elements to protect various parts of a wearer's mid-portion, such as, for example, dorsal pads to protect the kidneys, lower back and tailbone area, hip pads to protect the front and side portions of the hip bone, as well as thigh pads to protect the front portion of the thighs. As may be understood, various types of traditional hockey pants provide a number of combinations of this general protection pattern, but may also include additional protective elements to protect various other portions of the wearer's mid-section. Further, these various protective elements may or may not overlap and may be of a variety of different constructions.

A limitation of traditional hockey pants is that most if not all of these protective elements are fixed in place on the pant, i.e. stitched or closed in permanently. While some hockey pants provide for pockets which may be opened to remove protective padding contained therein, for example for washing and repairs, generally speaking the protective elements are fixed and their location is therefore determined by the manufacturer of the protective equipment. In most cases this is a permanent fixation which does not provide for any flexibility or allow for any change in either the size of the protective element, its location or the range of protection. This fixed protection level is not viewed favorably by a number of players, who may wish to have some latitude in the positioning of the protective elements on their pants.

Accordingly, improvements are desirable.

SUMMARY OF THE INVENTION

It is therefore an aim of the present invention to provide an improved core protector for protecting a wearer's mid-section.

Therefore, in accordance with the present invention, there is provided a core protector comprising a pant having a torso portion and two tubular leg portions extending therefrom in communication therewith, each leg portion defining an opening for receiving a leg of a wearer therein, and a thigh protector adjacent each leg opening, each thigh protector being detachably connected to the pant to provide protection to a thigh of the wearer.

Also in accordance with the present invention, there is provided a core protector comprising an inner pant having a torso portion and two leg portions, two thigh protectors each including a padding member for providing protection to a thigh of a wearer, and two attachment mechanisms, each attachment mechanism removably interconnecting a respective one of the thigh protectors with a respective one of the leg portions.

BRIEF DESCRIPTION OF THE DRAWINGS

Reference will now be made to the accompanying drawings, showing by way of illustration a particular embodiment of the present invention and in which.

DETAILED DESCRIPTION OF THE DRAWINGS

Figure 1:
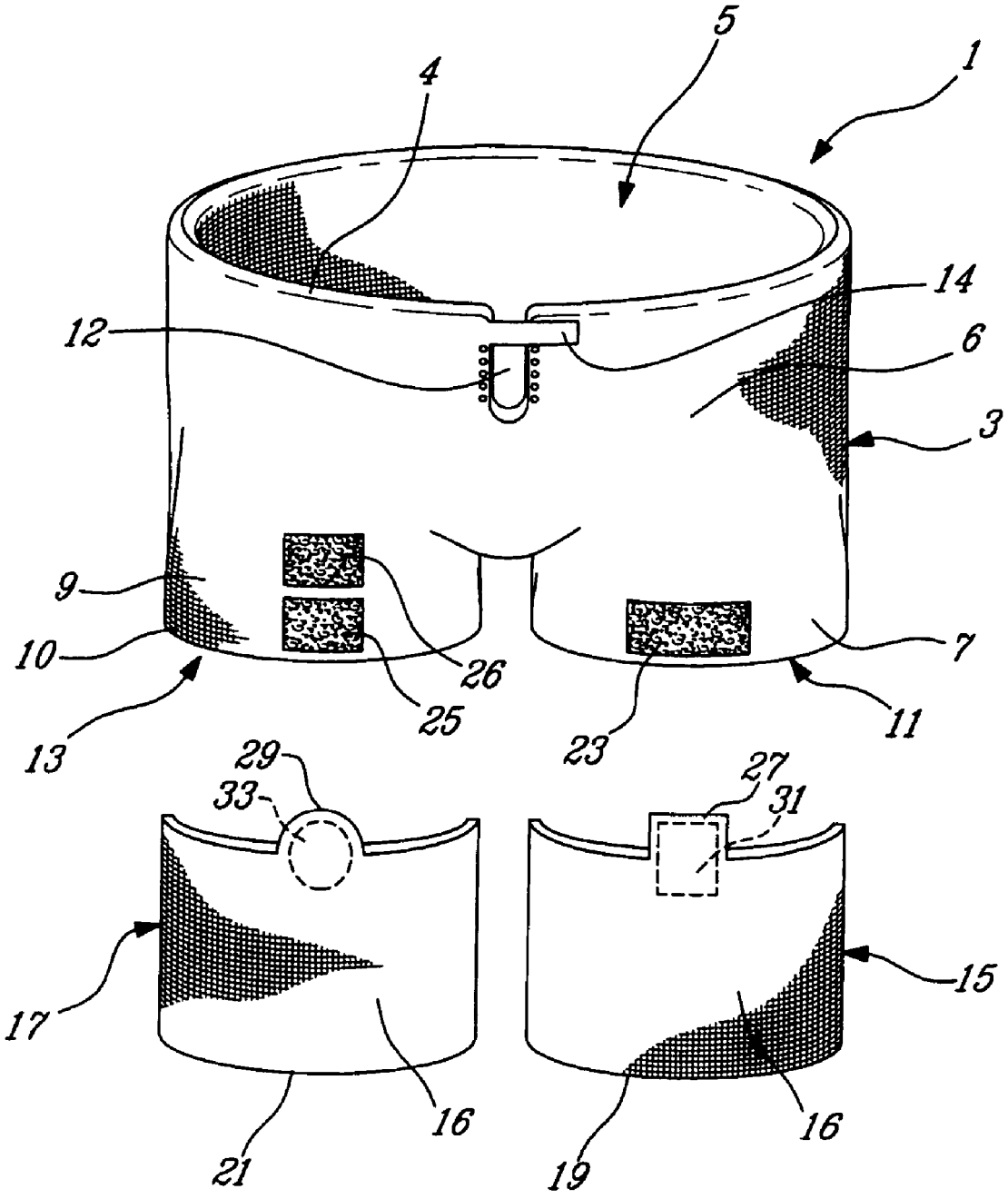
FIG. 1 is a front perspective view of a core protector according to a particular embodiment of the present invention, illustrating an inner pant thereof separate from thigh protectors thereof.

Referring to FIG. 1, a core protector in accordance with a particular embodiment of the present invention is generally shown at 1. As may be understood, the expression "core protector" designates generally the protection equipment which is meant to protect a wearer's mid-section, e.g. from the region above the knees to approximately the mid-abdomen, or possibly higher.

The core protector 1 comprises an inner pant 3, and two thigh protectors 15, 17. In a particular embodiment, the inner pant 3 is provided with padding thereon (not shown). This padding may come in a variety of configurations and shapes, and may for example be disposed so as to fit in pockets provided therefor in the inner pant material. The inner pant 3 may thus have pockets which are made of a piece of fabric additionally sewn or detachably connected thereto and/or provided in folds made in the inner pant material itself and/or if two or more layers of material are provided, through the sewing of the various layers together. The padding can be made, for example, of low-density foam, high-density foam, and/or a more rigid material such as for example a thermoplastic polymer.

In a particular embodiment, the inner pant 3 is of simple construction and configured and disposed to be in direct contact with the wearer. Alternately, the inner pant 3 may be worn over other garments, equipment, etc. of the wearer. Further, the inner pant 3 may also incorporate therein an athletic protector either on an inner surface or on an outer surface thereof.

In a particular embodiment, the inner pant 3 is made of light and breathable material, for example, of mesh-like material, or alternatively of other material which may provide strength and support yet be light and comfortable to wear. In addition, the inner pant 3 may be provided with a combination of materials, for example, stretchable material in some areas, so as to provide some element of form fitting function, and other non-stretchable materials which may be used to snuggly fit padding therein.

In a particular embodiment, the material of the inner pant is such that the inner pant closely fits onto the wearer's body, and is a stretchable material commonly used in the construction of sport equipment, such as for example, YH-L30, 82% nylon and 18% Spandex 40D. Alternately, the inner pant 3 may be loose about the wearer's body and/or be made of another adequate type of material such as cotton, other stretch nylon, regular nylon, Lycra, or any other appropriate materials or combination thereof.

The inner pant 3 includes a torso portion 6 and two leg portions 7, 9 extending from the torso portion 6 and in communication therewith. The torso portion 6 defines an upper circumferential edge 4 of the inner pant 3 bordering an upper opening 5 generally sized and configured to allow the abdomen of a wearer to be received therein. Each leg portion 7, 9 defines a lower circumferential edge 10 bordering a respective lower opening 11, 13 generally sized and configured to allow a respective thigh of the wearer to be received therein.

The inner pant 3 also includes a retaining member 14 disposed at or adjacent the upper circumferential edge 4 of the torso portion 6 to allow a tightening of the torso portion 6 around the abdomen of the wearer to maintain the core protector 1 in place thereabout. In the embodiment shown, the retaining member 14 includes a tab extending from one side of a slot 12 defined in the torso portion from the upper circumferential edge 4 thereof, and connected to the opposed side of the slot 12, for example through Velcro® fasteners. As may be understood, the retaining member 14 may include any other adequate means to retain the inner pant 3 about the abdomen or waist of the wearer, such as, for example, a belt, an elastic, buttons, snaps, a zipper, a drawstring, or any combination thereof.

Each leg portion 7, 9 includes an upper attachment member 23, 25 which in the embodiment shown is disposed on an outer surface thereof, adjacent the respective lower circumferential edge 10. In the embodiment shown, the core protector 1 also includes an additional upper attachment member 26 disposed on the outer surface of the right leg portion 9 above the upper attachment member 25. Although not shown, a similar additional attachment member can be provided on the left leg portion 7. The upper attachment members 23, 25, 26 are configured and disposed so as to be cooperatively engageable with complementary attachment members of the thigh protectors 15, 17, as will be further detailed below.

In the embodiment shown, the upper attachment members 23, 25, 26 include one or more pieces or strips of Velcro®. Alternate upper attachment members 23, 25 may include buttons, zippers, elastics or any appropriate attachment mechanism or combination thereof.

In alternate embodiments, the location of the upper attachment members 23, 25, 26 on the inner pant 3 may vary, even from one leg portion 7, 9 to the other. For example, the upper attachment members 23, 25, 26 may be disposed on an inner surface of the leg portions 7, 9, or may protrude downwardly from the leg portions 7, 9.

Still referring to FIG. 1, the thigh protectors 15, 17 are curved such as to substantially wrap around the front of or at least a portion of the front of a wearer's leg. In a particular embodiment, the thigh protectors 15, 17 include a front protective pad 16 including soft padding material. Alternate or additional materials for the protective pad 16 include, for example, thermoformable or thermosetting plastic, composite materials, other adequate light and hard material or a combination thereof. In a particular embodiment, the protective pad 16 of each thigh protectors 15, 17 includes therein a molded thermoplastic insert, and is wrapped in a material suitable for use with sporting equipment, such as for example nylon.

The thigh protectors 15, 17 each define a respective lower thigh edge 19, 21. It is understood that the disposition of the lower thigh edges 19, 21 may be higher or lower than shown, i.e. the size and configuration of the thigh protector 15, 17 may vary. As such, the thigh protectors 15, 17 can protect small portion of the thigh or alternately a substantial portion of the leg, e.g. from the inner pant 3 to the knee.

Each thigh protector 15, 17 has a respective tab 27, 29 projecting upwardly from a remainder of the thigh protector 15, 17, for example from the cover material forming an outer surface of the thigh protector 15, 17. The left tab 27 is shown as having a rectangular shape, while the right tab 29 is shown as having an arcuate shape, in order to illustrate two examples of possible shapes for the tabs 27, 29. As may be understood, the tabs 27, 29 may both have the same shape corresponding to one of the shapes shown or alternatively to another appropriate shape.

Each tab 27, 29 includes a respective lower attachment member 31, 33 which is complementary to one or more corresponding one(s) of the upper attachment member 23, 25, 26 of the inner pant 3. As such, the lower attachment members 31, 33 are sized and configured to cooperatively and selectively engage the corresponding upper attachment member 23, 25, 26, such that the inner pant 3 provides a supporting structure onto which the thigh protectors 15, 17 are adjustably and removably attached.

In the embodiment shown, the lower attachment members 31, 33 include one or more pieces or strips of Velcro®. Alternate lower attachment members 31, 33 may include buttons, zippers, elastics or any appropriate attachment mechanism or combination thereof, as long as the lower attachment members 31, 33 are complementary to the upper attachment members 23, 25, 26 for engagement therewith.

In alternate embodiments, the location of the lower attachment members 31, 33 on the thigh protector 15, 17 may vary, even from one thigh protector 15, 17 to the other, as long as the location of the lower attachment members 31, 33 is complementary to that of the upper attachment members 23, 25, 26 for engagement therewith.

Figure 2:
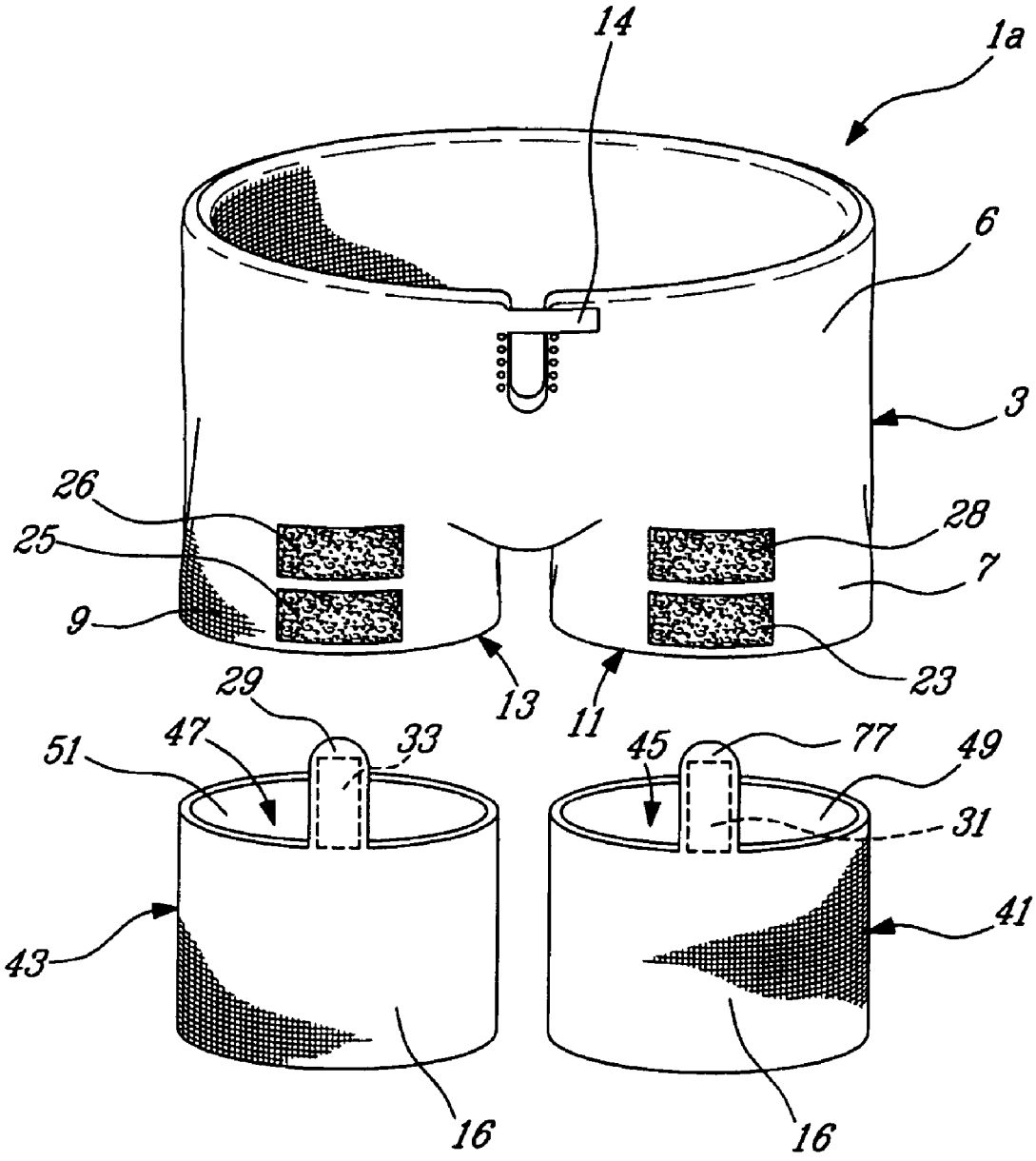
FIG. 2 is a front perspective view of a core protector according to an alternate embodiment of the present invention, illustrating an inner pant thereof separate from thigh protectors thereof.

FIG. 2 illustrates a core protector 1*a* according to an alternate embodiment of the present invention. The core protector 1*a* includes an inner pant 3 similar to that of the core protector 1 previously described, with the exception that an additional upper attachment member 28 is provided on an outer surface of the left leg portion 7, above the upper attachment member 23 located adjacent the lower circumferential edge 10.

The core protector 1*a* includes two thigh protectors 41, 43 which are each curved so as to follow the shape of the thigh of the wearer. Each thigh protector 41, 43 has a respective tab 27, 29 projecting upwardly therefrom, which each tab 27, 29 including a respective lower attachment member 31, 33 which is complementary to one or more corresponding one(s) of the upper attachment members 23, 25, 26, 28 of the inner pant 3.

Each thigh protector 41, 43 has a tubular shape, i.e. includes a rear wall 49, 51 extending from the front protective pad 16 and passing behind the leg of the wearer such that the thigh protector 41, 43 surrounds the respective leg. As such, each thigh protector 41, 43 defines a thigh protector opening 45, 47 through which the leg of the wearer may be slipped. In a particular embodiment, in order to achieve a snug fit of the thigh protector 41, 43 around the respective thigh, the rear wall 49, 51 is partially or completely made of an elastic and/or elasticized material.

Figure 3:
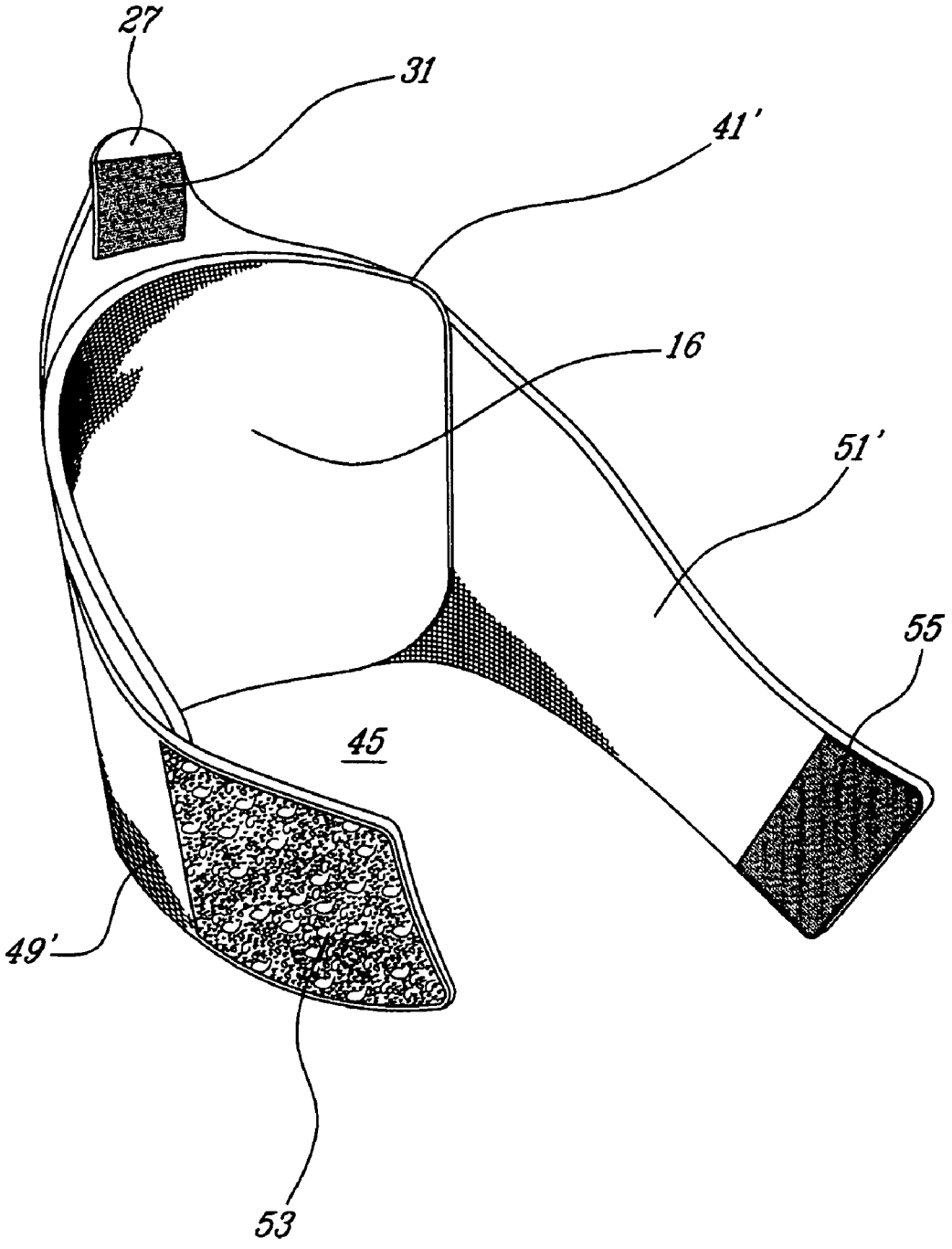
FIG. 3 is a back perspective view of an alternate thigh protector shown in an open configuration.

FIG. 3 illustrates an alternate thigh protector 41' which, in use, is wrapped around the thigh of the wearer. Similarly to the above described thigh protectors 15, 17, 41, 43, the thigh protector 41' includes a tab 27 having a lower attachment member 31 which is engageable with one or more corresponding one(s) of the upper attachment members 23, 25, 26, 28 of the inner pant 3 illustrated in FIG. 2.

The thigh protector 41' also includes two rear tabs 49', 51' extending rearwardly from the front protective pad 16. In a particular embodiment, the rear tabs 49', 51' are made of elastic and/or elasticized material. When the rear tabs 49', 51' are opened, i.e. when they are not engaged with one another, the front protective pad 16 is disposed against the thigh of the wearer, and the rear tabs 49', 51' are folded back around the back of the thigh and engaged to one another so as to enclose the thigh with the thigh protector 41'. To that end, a respective rear attachment member 53, 55 is provided on each rear tab 49', 51', the rear attachment members 53, 55 being complementary to be cooperatively engageable with one another. In the embodiment shown, the rear attachment members 53, 55 include complementary Velcro® strips, but alternate attachment members can be used such as, for example, buttons, zippers, snaps, metal hooks, or any appropriate attachment mechanism or combination thereof.

As the rear tabs 49', 51' allow for the thigh protector 41' to be wrapped around the leg, the thigh protector 41' may be snuggly fitted around the thigh of the wearer. Alternately, the attachment point of the rear tabs 49', 51', which is shown here to be at the back of the wearer's leg, may be disposed on either side of the leg. Further, more than one piece of material may replace the tabs rear 49', 51'.

Figure 4:
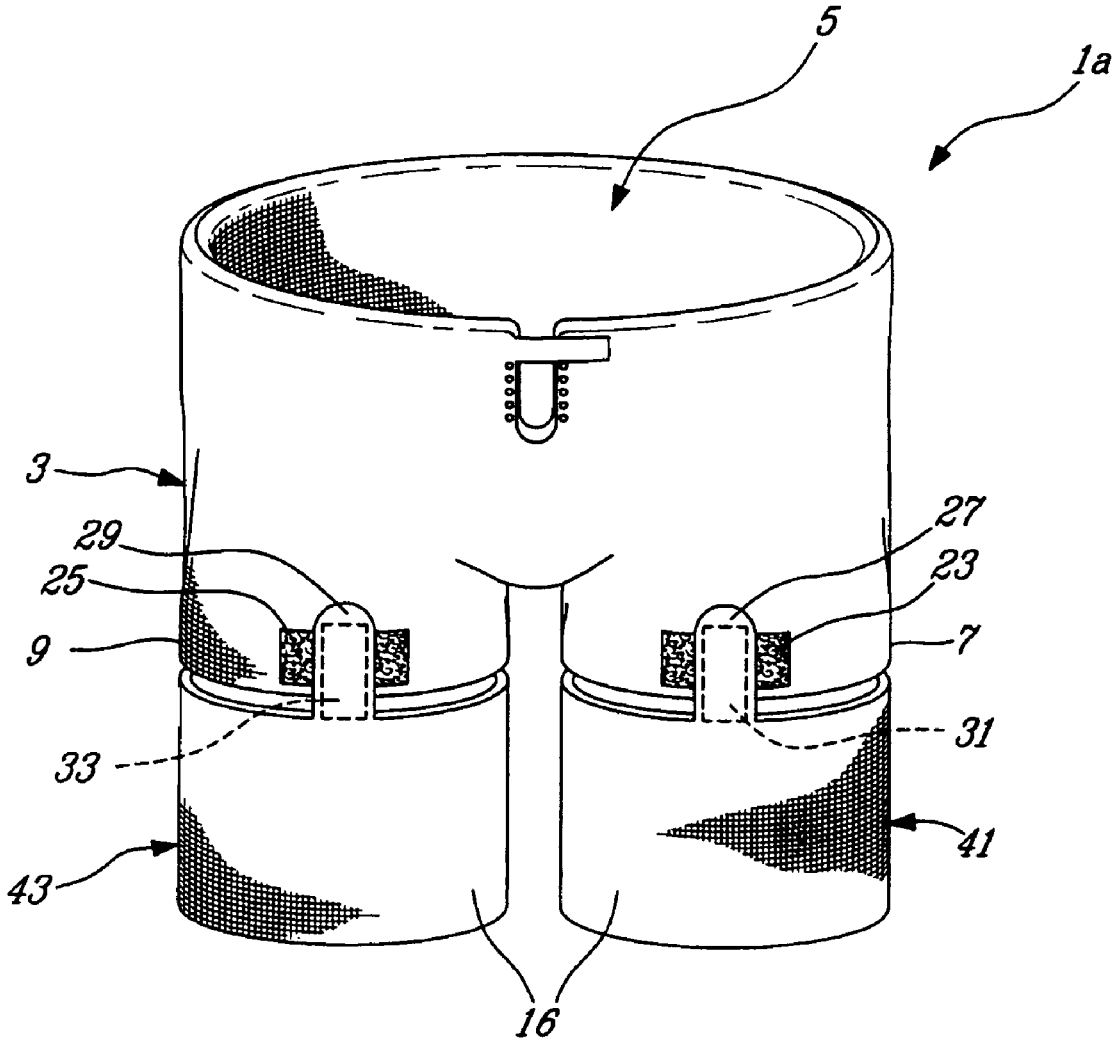
FIG. 4 is a front perspective view of a core protector similar to that of FIG. 2, illustrating the thigh protectors attached to the inner pant.

FIG. 4 illustrates the core protector 1*a* (with the additional upper attachment members 26, 28 omitted) of FIG. 2 showing the thigh protectors 41, 43 attached to the inner pant 3. As may be seen, the tabs 27, 29 are brought upwardly so as to overlap the upper attachment members 23, 25. The lower attachment members 31, 33 cooperatively engage the upper attachment members 23, 25 so as to temporarily and removably attach the thigh protectors 41, 43 to the respective leg portion 7, 9. The attachment members 23, 25, 31, 33 are engaged along only a portion thereof, such that the thigh protectors 41, 43 are attached in a selected one of a plurality of positions by selecting a relative position of each lower attachment member 31, 33 with respect to the respective upper attachment member 23, 25.

The additional upper attachment members 26, 28 (see FIG. 2) allow each lower attachment member 31, 33 to be selectively engaged with one of two corresponding upper attachment members 23, 25, 26, 28, such that the wearer can further adjust the thigh protectors 41, 43 to a desired height around his/her thighs.

Figure 5:
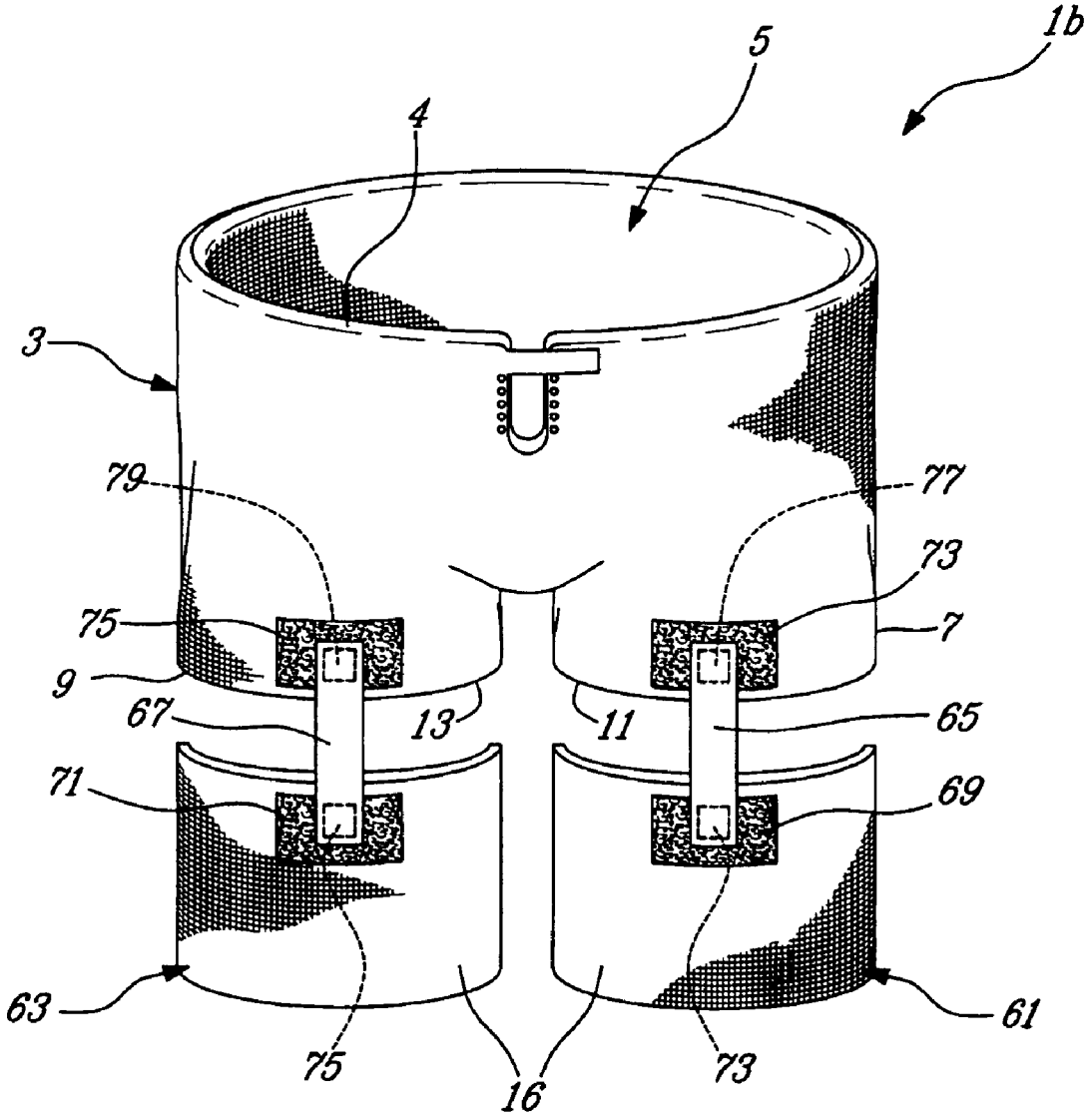
FIG. 5 is a front perspective view of a core protector according to an alternate embodiment of the present invention, illustrating an inner pant thereof with thigh protectors attached thereto.

FIG. 5 illustrates a core protector 1*b* according to an alternate embodiment of the present invention. The core protector 1*b* includes an inner pant 3 similar to that of the core protector 1 previously described, with the additional upper attachment member 26 being omitted. The core protector 1*b* also includes thigh protectors 61, 63 which are shown to be similar in shape to the thigh protectors 15, 17 of FIG. 1, with the tabs 27, 29 being omitted. Alternately, the thigh protectors 61, 63 can be similar to the thigh protectors 41, 43 of FIG. 2 or to the thigh protector 41' of FIG. 3.

In this embodiment, each thigh protector 61, 63 includes a respective lower attachment member 69, 71 provided directly on a front outer surface thereof. Alternate locations for the lower attachment members 69, 71 include, for example, along an inner surface of the thigh protector 61, 63 and/or at the back thereof.

The upper attachment members 23, 25 are shown as being located on a front outer surface of the inner pant 3 adjacent the lower circumferential edge 10 of each leg portion 7, 9 as in the previous embodiments, but can alternately, be included at other locations of the inner pant 3, for example closer to the circumferential upper circumferential edge 4 and/or on the inner surface of the leg portions 7, 9.

In this embodiment, the upper and lower attachment members 23, 25, 69, 71 are not attached directly to one another but are rather interconnected through a corresponding strap 65, 67. As such, each strap 65, 67 includes a lower strap attachment member 73, 75 at one end engaged to a respective lower attachment member 69, 71 of the respective thigh protector 61, 63, and an upper strap attachment member 77, 79 at the other end engaged to a respective upper attachment member 23, 25 of the inner pant 3.

In a particular embodiment, the straps 65, 67 are elastic, i.e. made of an elastic material commonly used in sporting equipment. Thus, the straps 65, 67 may have a sufficient element of elasticity, i.e. they have some 'give' which allows the thigh protectors 61, 63 to move with respect to the inner pant 3, namely up or down. Alternatively, the straps 65, 67 may be from a non-elastic or substantially non-elastic material. For example, nylon, cotton and other such materials may be employed, although it is understood that these materials will somewhat deform when pulled.

In the embodiment shown, the upper attachment members 23, 25 and upper strap attachment members 77, 79 include complementary pieces of Velcro®, and the lower attachment members 69, 71 and lower strap attachment members 73, 75 also include complementary pieces of Velcro®. As such, four detachable and adjustable connection points exist between the inner pant 3 and the thigh protectors 61, 63.

Alternatively, one or more of the connection points may be fixed, i.e. not detachable. For example, the lower attachment members 69, 71 may be omitted, and the straps 65, 67 may be permanently affixed to the thigh protectors 61, 63, such that the freedom to selectively position the thigh protectors 61, 63 occurs simply from positioning the straps 65, 67 in relation to the upper attachment members 23, 25. The reverse may also be considered, where the upper attachment members 23, 25 are omitted and the straps 65, 67 are permanently affixed to the leg portions 7, 9. Further, other attachment members other than Velcro® may alternately be used, for example buttons, zippers, snap buttons and others, or any combination thereof.

Figure 6:
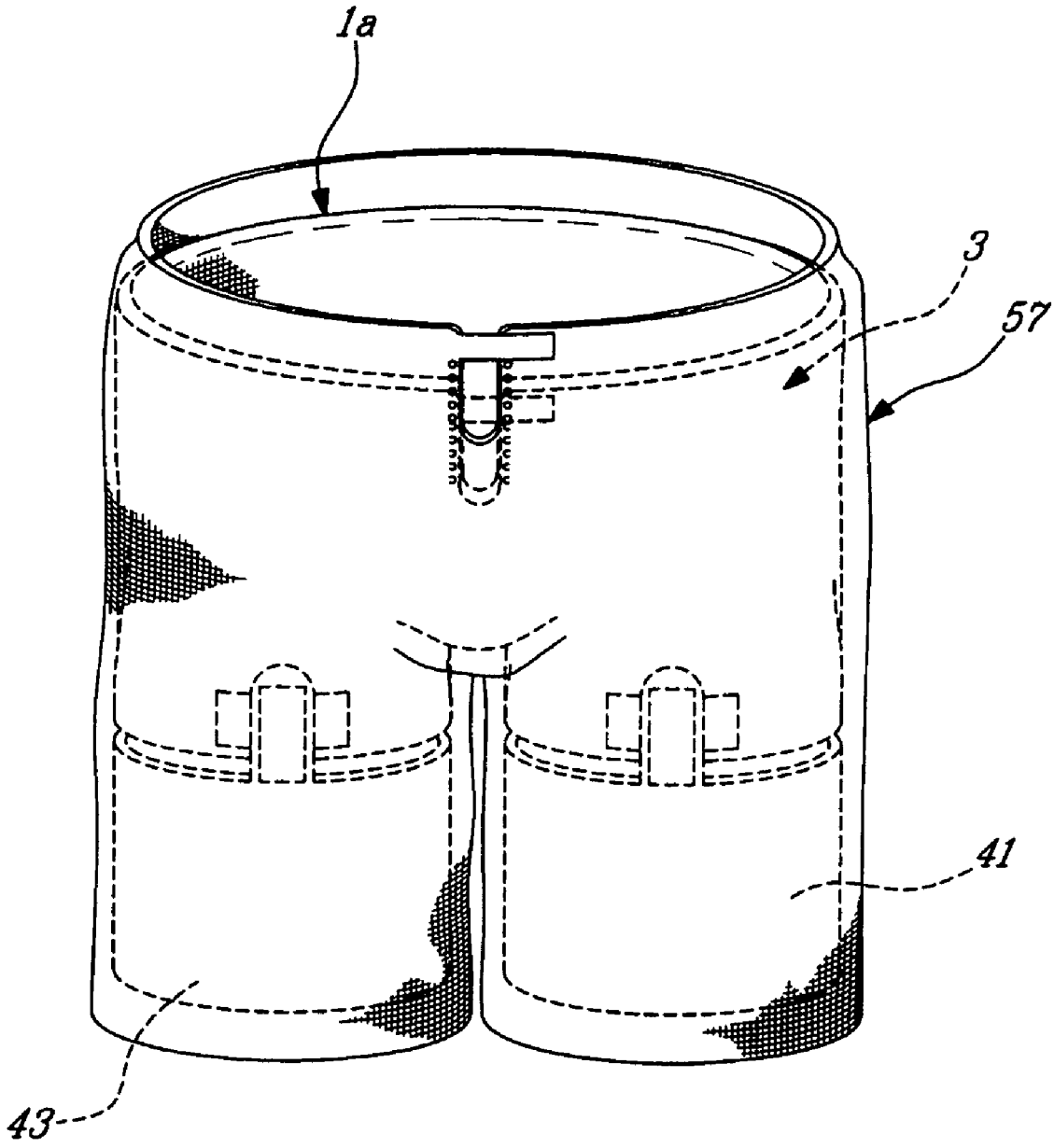
FIG. 6 is a front perspective view of a hockey pant including a core protector such as shown in FIG. 2 and an outer shell covering the core protector.

FIG. 6 illustrates the core protector 1*a* shown in FIG. 4 covered by an outer shell 57, which covers the inner pant 3 and the thigh protectors 41, 43, such as to define a hockey pant. Additional padding and/or protection may be provided in or on the outer shell 57. As may be understood, a core protector 1, 1*a*, 1*b* such as described herein may be sold to retail outlets and purchased by the user with or without the shell 57, or with more than one outer shell 57, for example, one marked with the home colors of the team, and one with the road colors.

The outer shell 57 acts as a form of wrapping to keep the combination of the inner pant 3 and thigh protectors 41, 43 in place, and/or to prevent the thigh protectors 41, 43 from being accidentally displaced and/or ripped off their attachment during play. In a particular embodiment, the outer shell 57 is made of a strong nylon or any other material or combination thereof suitable for an impact sport such as hockey.

In a particular embodiment, the outer shell 57 is attached to the inner pant 3, for example through the use of Velcro®, zippers, snap buttons, buttons, or other attachment means or combination thereof. Alternatively, the outer shell 57 may not be fixed to the inner pant 3 but rather may simply rest outside of the inner pant 3, i.e. it may be "floating".

In a particular embodiment, the core protector 1, 1*a*, 1*b* alone is used as a hockey pant, i.e. without an outer shell 57 to cover it.

The core protector 1, 1*a*, 1*b* thus provides thigh protectors 15, 17, 41, 41', 43, 61, 63 which are configured and designed so as to be removably attached to the inner pant 3. As may be understood, the thigh protectors 15, 17, 41, 41', 43, 61, 63 are configured and disposed so as to protect at least a portion of a wearer's thigh, for example against impact from pucks or sticks.

The core protector 1, 1*a*, 1*b* thus comprises adjustable attachment mechanisms defined by the attachment members 23, 25, 26, 28, 31, 33, 69, 71 either directly interconnected or interconnected through the straps 65, 67. These adjustable attachment mechanisms allows each thigh protector 15, 17, 41, 41', 43, 61, 63 to be both vertically and horizontally adjusted at will each independently of the other, by detachably interconnecting the attachment members 23, 25, 26, 28, 31, 33, 69, 71, directly or through the straps 65, 67, in different relative positions. As may be understood, different players may have different likes and dislikes, as well as different requirements for protection of their thighs. Thus, the core protector may generally allow for a player to attach the thigh protector(s) 15, 17, 41, 41', 43, 61, 63 in any number of possible ways. For example, a player may wish to have thigh protectors disposed further down the thigh, or conversely a player may wish to have thigh protectors disposed higher up the thighs so as to leave no or little gap between the thigh protectors and the inner pant.

Further, the thigh protectors 15, 17, 41, 41', 43, 61, 63 are adjustable through the adjustable attachment mechanisms so as to protect more of the outer portion of a player's thigh or, conversely, more of the inner portion of a player's thigh. As may be understood, this flexibility in the positioning of the thigh protectors 15, 17, 41, 41', 43, 61, 63 may be particularly useful to accommodate various player tastes and preferences, but may also be very useful in order to provide additional protection to a player having an injury to a particular part of the thigh.

The thigh protectors 15, 17, 41, 41', 43, 61, 63 may be adjusted at will by the player. As may be understood, the attachment members 23, 25, 26, 28, 31, 33, 69, 71, 73, 75, 77, 79 of the core protector 1 are such that the player may adjust the location of the thigh protectors 15, 17, 41, 41', 43, 61, 63 any number of times, i.e. when dressing, when trying and adjusting his/her equipment, and even during a game or practice. As may further understood, a player may choose to have the left thigh protector 15, 41, 41', 61 disposed differently than the right thigh protector 17, 41', 43, 63. Alternatively, a player may choose to remove one or both of the thigh protector 15, 17, 41, 41', 43, 61, 63.

More than one thigh protector 15, 17, 41, 41', 43, 61, 63 per leg may be provided, each of which may be removably attached. For example two or more thigh protectors 15, 17, 41, 41', 43, 61, 63 may be provided for each leg, each being selectively adjustable by the wearer.

The embodiments of the invention described above are intended to be exemplary. Those skilled in the art will therefore appreciate that the foregoing description is illustrative only, and that various alternatives and modifications can be devised without departing from the spirit of the present invention. For example, the present device could be use in numerous other types of protection equipment, and should not be viewed as limited to hockey or even to sports. Accordingly, the present invention is intended to embrace all such alternatives, modifications and variances which fall within the scope of the appended claims.

The invention claimed is:

1. A hockey pant assembly comprising an outer shell and an inner core protector received within the outer shell, the core protector including a pant having a torso portion and two tubular leg portions extending therefrom in communication therewith, each leg portion defining an opening for receiving a leg of a wearer therein, and a thigh protector adjacent each leg opening, each thigh protector being detachably connected to the tubular leg portions to provide protection to a thigh of the wearer, each thigh protector being remote from a lower edge of a respective one of the tubular leg portions and articulated therewith so as to move independently from the respective one of the tubular leg portions, wherein each thigh protector includes a protective padding member sufficiently rigid to maintain a preformed curved shape so as to at least partially wrap around a front of the thigh of the wearer and to protect the thigh of the wearer from impact during hockey, and each thigh protector is configured to not extend below an upper portion of the knee of the wearer.

2. The hockey pant assembly according to claim 1, wherein the pant includes at least one first attachment member provided on each leg portion, and each thigh protector includes at least one second attachment member, each second attachment member being detachably connected to the first attachment member of a respective one of the leg portions.

3. The hockey pant assembly according to claim 2, wherein each second attachment member is detachably connected to the first attachment member of the respective leg portion through a strap, the strap having one end detachably connected to the second attachment member and an opposed end detachably connected to the first attachment member.

4. The hockey pant assembly according to claim 2, wherein the first attachment member is provided on an outer surface of the leg portion adjacent a lower edge thereof.

5. The hockey pant assembly according to claim 2, wherein the second attachment member is provided on a tab extending upwardly from a remainder of the thigh protector.

6. The hockey pant assembly according to claim 1, wherein the pant includes at least two vertically spaced apart first attachment members provided on each leg portion, and each thigh protector includes at least one second attachment member, each second attachment member being detachably connected to a selected one of the first attachment members of a respective one of the leg portions.

7. The hockey pant assembly according to claim 1, wherein each thigh protector is detachably connected to the pant in a selected one of a plurality of positions relative thereto.

8. The hockey pant assembly according to claim 1, wherein each thigh protector is detachably connected to the pant through a strap extending therebetween.

9. The hockey pant assembly according to claim 8, wherein each strap includes an elastic material.

10. The hockey pant assembly according to claim 1, wherein each thigh protector has a tubular shape such as to surround the thigh.

11. The hockey pant assembly according to claim 10, wherein the thigh protector includes a rear wall which are interconnected to define the tubular shape, the rear wall including an elastic material.

12. The hockey pant assembly according to claim 1, wherein each thigh protector includes tabs extending rearwardly therefrom, the tabs being detachably engageable to one another along a rear portion of the thigh when the padding member rests against a front portion of the thigh.

13. The hockey pant assembly according to claim 1, wherein each protective padding member is configured to not fully extend around the thigh of the wearer.

14. A core protector for a hockey pant assembly having an outer shell within which the core protector is received, the core protector comprising:

an inner pant having a torso portion and two leg portions;

two thigh protectors, each thigh protector including a protective padding member sufficiently rigid to maintain a preformed curved shape so as to at least partially wrap around a front of the thigh of the wearer and to protect a thigh of a wearer from impact during hockey, each thigh protector being remote from a lower edge of a respective one of the leg portions and articulated therewith so as to move independently from the respective one of the leg portions, each thigh protector being configured to not extend below an upper portion of the knee of the wearer; and two attachment mechanisms, each attachment mechanism removably interconnecting the respective one of the thigh protectors with the respective one of the leg portions.

15. The core protector according to claim 14, wherein each attachment mechanism includes a first attachment member provided on the respective leg portion and a second attachment member provided on the respective thigh protector, the first and second attachment member being detachably interconnected.

16. The core protector according to claim 15, wherein each attachment mechanism includes a strap detachably interconnecting the first and second attachment members.

17. The core protector according to claim 16, wherein each strap includes an elastic material.

18. The core protector according to claim 14, wherein each attachment mechanism removably interconnects the respective thigh protector with the respective leg portion in a selected one of a plurality of positions.

19. The core protector according to claim 14, wherein each thigh protector has a tubular shape such as to surround the thigh.

20. The core protector according to claim 19, wherein each thigh protector includes a rear wall connected to the padding member to define the tubular shape, the rear wall including an elastic material.

21. The core protector according to claim 14, wherein each thigh protector includes tabs extending rearwardly from the padding member, the tabs being detachably engageable to one another along a rear portion of the thigh when the padding member rests against a front portion of the thigh.

22. The hockey pant assembly according to claim 1, wherein the protective padding member of the thigh protector has a rigidity greater than that of a majority of the pant.

23. The hockey pant assembly according to claim 1, wherein the protective padding member of the thigh protector is composed of a material including one or more of low-density foam, high-density foam, thermoplastic, and composite.

24. The core protector according to claim 14, wherein the protective padding member of the thigh protector has a rigidity greater than that of a majority of the inner pant.

25. The core protector assembly according to claim 14, wherein the protective padding member of the thigh protector is composed of a material including one or more of low-density foam, high-density foam, thermoplastic, and composite.

26. The core protector according to claim 14, wherein each protective padding member is configured to not fully extend around the thigh of the wearer.

27. A core protector for a hockey pant assembly having an outer shell within which the core protector is received, the core protector comprising:

an inner pant having a torso portion and two leg portions;

two thigh protectors, each thigh protector including a protective padding member sufficiently rigid to maintain a preformed curved shape so as to at least partially wrap around a front of the thigh of the wearer and to protect a thigh of a wearer from impact during hockey, each thigh protector being remote from a lower edge of a respective one of the leg portions and articulated therewith so as to move independently from the respective one of the leg portions, each protective padding member being configured to not fully extend around the thigh of the wearer; and two attachment mechanisms, each attachment mechanism removably interconnecting the respective one of the thigh protectors with the respective one of the leg portions.

* * * * *